United States Patent [19]

Dinger et al.

[11] Patent Number: 4,755,829

[45] Date of Patent: Jul. 5, 1988

[54] SPACE POWER COMBINER

[75] Inventors: Robert J. Dinger; David J. White; Donald R. Bowling, all of Ridgecrest, Calif.

[73] Assignee: The United States of America as represented by the Secretary of the Navy, Washington, D.C.

[21] Appl. No.: 16,917

[22] Filed: Feb. 20, 1987

[51] Int. Cl.[4] ..... H01Q 21/00

[52] U.S. Cl. ..... 343/853; 342/371; 342/372

[58] Field of Search ..... 343/853, 700 MS File; 342/368, 369, 371, 372

[56] References Cited

U.S. PATENT DOCUMENTS

| | | | |
|---|---|---|---|
| H26 | 2/1986 | Dinger | 343/372 |
| H375 | 11/1987 | Dinger | 342/372 |
| 3,392,393 | 7/1968 | Spitz | 342/376 |
| 3,653,046 | 3/1972 | Glance | 342/371 |
| 4,118,598 | 10/1978 | Risko et al. | 455/39 |
| 4,394,660 | 7/1983 | Cohen | 342/369 |
| 4,514,707 | 4/1985 | Dydyk et al. | 331/107 SL |

*Primary Examiner*—William L. Sikes
*Assistant Examiner*—Hoanganh Le
*Attorney, Agent, or Firm*—W. C. Townsend; W. Thom Skeer; Stephen J. Church

[57] ABSTRACT

An antenna array for combining in space microwave energy from a number of oscillators, such as IMPATT diodes, which are controllable by injection locking. The array has elements individually driven by the oscillators, but an injection locking signal is provided in the usual manner only to the oscillator of a central element. The other oscillator are injection locked through mutual coupling between the central element and the other elements so that coherent radiation is output by the array. The radiation may be steered by phase shifters between the elements and their oscillators.

5 Claims, 1 Drawing Sheet

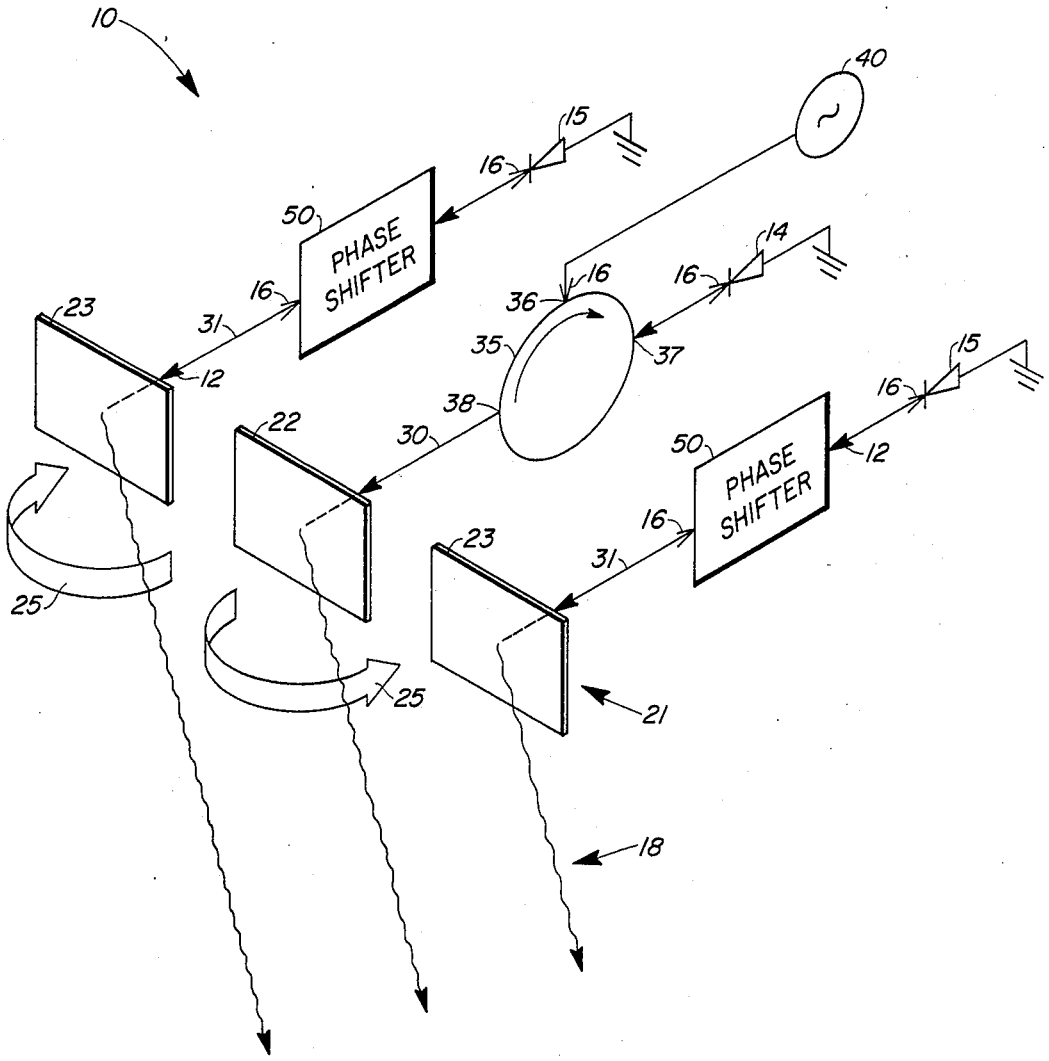
10
40
15
16
50
PHASE SHIFTER
14
16
36
16
23
31
35
37
12
15
16
38
22
30
50
PHASE SHIFTER
12
16
23
31
25
25
21
18

SPACE POWER COMBINER

BACKGROUND OF THE INVENTION

1. Field of the Invention

The present invention pertains to the fields of radio wave communications and oscillators. More particularly it pertains to plural active antennas driven by plural parallel connected oscillators.

2. Description of the Prior Art

IMPATT diodes are well known as a solid-state source of microwave energy. However, each IMPATT diode outputs relatively little power and the outputs of similar diodes are incoherent and at different frequencies. Heretofore, the output of a number of diodes, typically, has been provided by a relatively inefficient and bulky combiner which also provides for frequency control by injection locking from a separate source.

If an antenna array is powered by IMPATT diodes, either the array elements can be driven by a single such combiner through a relatively bulky and inefficient branching feed, or a diode may be relatively directly connected to each element. In the latter arrangement injection locking is provided from a single source and distributed to each diode, typically through circulators individual to the diodes, so that a relatively bulky and complex branching feed is not avoided.

Since arrays are typically used becuse they provide a steerable beam and since it is, ultimately, desired to provide large integrated circuit arrays of planar configuration, it is highly desirable that any arrangement for driving an array from a plurality of diodes be adapted for beam steering and be adaptable for use in such a configuration, particularly by elimination or simplification of signal distribution networks and by elimination of circulators which cannot be deposited by the usual integrated circuit making techniques.

SUMMARY OF THE INVENTION

The subject invention utilizes the discovery of the present applicants that, in an antenna array having for each element of the array an oscillator such as an IMPATT diode requiring injection locking for frquency and phase determination, an injection locking signal need be provided in the usual manner only to the oscillator of one element if sufficient free space mutual coupling is provided between the one element and the other elements of the array. The other oscillators are synchronized by injection locking through the mutual coupling so that coherent radiation is emitted by the elements into free space and the emitted energy is there combined into a beam steerable by phase shifters between each such other element and the associated oscillator.

It is an object of the present invention to coherently combine microwave energy from a plurality of oscillators, such as IMPATT diodes, requiring injection lockng for synchronization.

Another object is to combine the energy from such oscillataors as a beam from an antenna array without the use of a branching feed network to distribute either an injection locking signal or the combined power or a plurality of oscillators.

A further object is to provide an antenna array in which elements are directly and individually driven by such oscillators and in which the elements, oscillators, and beam steering devices are adapted for construction as a planar integrated circuit.

A still further object is to provide a structure for the combination of microwave energy from such oscillators with high efficiency into a coherent, steerable beam.

BRIEF DESCRIPTION OF THE DRAWING

Other objects, advantages, and novel features of the subject invention will become apparent from the following detailed description when considered with the accompanying drawings in which the FIGURE is a block diagram of a power combining system radiating conventionally represented microwave energy generated by a plurality of diodes and combined in free space in accordance with the present invention.

DESCRIPTION OF THE PREFERRED EMBODIMENT

The FIGURE shows a system, which is indicated generally by the numeral 10 and embodies the principles of the present invention, for generating microwave energy 12, at a predetermined frequency and at a relatively high level as indicated by heavy arrowheads, from a plurality of microwave sources or oscillators 14 and 15, depicted as three diodes and subsequently described at greater length, which require injection locking signals 16, at a relatively lower level and indicated by lighter arrowheads, to determined the frequency and phase of the generated energy, and for combining this energy in space as a coherent beam 18 by radiation from an antenna array 21 of system 10. Array 21, which has a plurality of elements 22 and 23 individually corresponding to and driven by oscillators 14 and 15, is, preferably, of well-known microstrip construction in which elements 22 and 23 are patch antennas.

In array 21, element 22 is a first or primary centrally located element and elements 23 are each a secondary element and are disposed at opposite sides of element 22. Elements 22 and 23 are configured, in a manner well-known to those skilled in the art of microstrip antenna design, to resonate and to radiate microwave energy at the predetermined frequency of system 10. Array 21 is also configured so that elements 23 have free space mutual coupling, as indicated by broad arrows 25, to central element 22. It is usually undesirable in an antenna array, which is similar to array 21 in having individual actively driven elements, to provide mutual free space coupling between the elements. Such coupling is essential to the present invention and may be provided to a suitable extent, about −13 decibels, by constructing array 21 in accordance with principles well known to these in art of antenna array design. A microstrip antenna array, such as 21, having only three elements is effective to carry out the present invention and provides simplicity helpful in explanation; however, it will be apparent to one skilled in the art that very much larger arrays embodying the present invention can be easily constructed to provide greater power, improved directivity, and two-dimensional beam steering. It will also be apparent that, while microstrip arrays have certain advantages discussed subsequently, the present invention may be practiced with antenna arrays in which the elements are slots or dipoles.

Oscillator 14 corresponds to element 22 and the set of oscillators 15 correspond individually to the set of elements 23. Oscillators 14 and 15 typically are substantially identical and each is an IMPATT diode having the well-known characteristic of oscillating over a range of frequencies unless provided with an injection locking signal. It will be apparent that the present invention may be practiced with other kinds of microwave sources, such as magnetrons, having an inherent frequency but controllable by injection locking. Diodes 14 and 15 are, although preferable, only representative of oscillators usable with the present invention. Therefore, elements such as bias supply and matching transformers necessary for operation of an IMPATT diode but well-known in the art are not depicted or further described.

System 10 has a transmission line 30, which connects diode 14 only to element 22, and has a set of transmission lines 31 which individually interconnect each diode 15 only with the corresponding one of the elements 22. Transmission line 30 is provided with a well-known circulator 35 having a first port 36, a second port 37 connected only to diode 14, and a third port 38 connected only to element 22. System 10 has a stable oscillator 40 of any suitable construction which inherently oscillates at the predetermined frequency of system 10 and provides a base injection locking signal to port 36 of circulator 35. This circulator leads the base signal to diode 14 so that this diode oscillates at the predetermined frequency with a phase determined by oscillator 40. Diode 14 thus generates microwave energy which is conducted to element 22 over line 30 by way of circulator ports 37 and 38 and is then radiated into free space from element 22. Although oscillator 40, circulator 35, line 30, and diode 14 operate in a well-known manner to provide an injection locked IMPATT diode arrangement directly driving one element of array 21, it should be noted that there is no branching feed structure for providing the base injection locking signal to the other diodes 15. It should also be noted there is no branching feed structure for providing microwave energy from any one of the diodes 14 and 15.

A portion of the microwave energy radiated by element 22 is coupled, as before mentioned and indicated by arrows 25, to each element 23 and conducted by the corresponding one of the transmission lines 31 to the associated one of the diodes 15 as an injection locking signal at the predetermined frequency of system 10. As a result, each diode 15 oscillates at this frequency and at a phase relative to that of element 22 determined by the coupling characteristics of element 22 and 23 and by the effective length of transmission lines 31. Each diode 15 therefore generates additional higher level microwave energy which is at the frequency of system 10 and is conducted over a transmission line 31 to the corresponding element 23 and there radiated into free space with a phase, relative to energy radiated from element 22, as determined by the effective length of the transmission line. Since the energy radiated from elements 23 has the same frequency as that from element 22 and has a fixed phase relative thereto, it is apparent that energy from all of the elements 22 and 23 is radiated as a coherent beam 18.

It will also be apparent that beam 18 may be steered in a well known manner and in the plane of array 21 by selectively varying the relative phases of energy radiated from elements 23 in relation to that from elements 22. Preferably, this phase variation is obtained by the provision of any suitable phase shifter 50 in each transmission line 31. Phase shifters 50 may be circulators each having a variable length short so that only the relative phase of the injection locking signal between element 23 and the associated diode is affected, or phase shifters 50 may be well-known line stretchers or varactor diodes which affect the phase relation in both directions along a transmission line. Since there or other well-known arrangements for phase shifting may be used in the practice of the present invention, no specific arrangement is depicted.

However, since it is often desirable to actively steer a beam such as beam 18, the use for phase shifters 50 of devices such as varactor diodes is highly advantageous. It will be apparent to one skilled in the art that, by using a microstrip array 21, by using IMPATT diodes as oscillators 14 and 15, and by using varactor diodes as phase shifters 50, substantially all of system 10, except for one circulator 35, may be constructed as a single, planar integrated circuit which, may of course, have a great many more secondary elements 23 and oscillators 15 than the two of each depicted in the FIGURE.

Obviously, many other modifications of the present invention from the specific disclosure herein are possible in the light of the above teachings, so that the invention may be practiced within the scope of the following claims other than as specifically described above.

What is claimed is:

1. A system for radiating coherent microwave radiation at a predetermined frequency, the system comprising:

a first antenna element and a second antenna element free space coupled thereto at said frequency;

a first IMPATT diode oscillator and a second IMPATT diode oscillator;

means for generating an injection locking signal at said frequency;

circulator means, which has a first port receiving said signal, a second port connected to said first oscillator and a third port connected to said first element, for leading said signal to the first oscillator so that the first oscillator generates microwave energy at said frequency, and for leading said energy to the first element so that said energy is radiated therefrom and a portion of said energy is free space coupled to the second element;

transmission line means, which interconnects the second element and the second oscillator, for transmitting said portion of said energy as an injection locking signal to the second oscillator so that said second oscillator generates additional microwave energy at said frequency, and for transmitting said additional energy to the second element for radiation therefrom in coherence with the energy radiated from the first element.

2. The system of claim 1 wherein said transmission line includes phase shifter means for changing the relative phase of said additional energy from the second element in relation to said energy radiated from the first element.

3. A system for radiating coherent microwave radiation at a predetermined frequency, the system comprising:

an antenna array having a plurality of elements each configured to resonant at said frequency and radiate thereat microwave energy at a relatively higher level, said elements including a primary element and a set of secondary elements having individual free space mutual coupling to the primary element at said frequency;

a plurality of microwave sources including one such source corresponding to the first element and a set of sources individually corresponding to the secondary elements, each of said sources oscillating to generate microwave energy at said frequency and at such a relatively higher level when provided with a relatively lower level injection locking signal at said frequency;

oscillator means which inherently oscillates at said frequency for generating a base signal at such a relatively lower level;

means for providing said base signal only to said one source as such an injection locking signal therefor, so that said one source generates microwave energy at said frequency and at such a higher level;

first transmission line means for conducting such relatively higher level energy at said frequency from said one source to the primary element so that the primary element radiates into free space such energy received from the primary source at such a higher level and so that a portion at such a lower level of such energy radiated from the primary element at said frequency is free space coupled to each of the secondary elements; and a set of secondary transmission line means, which individually connect each the secondary element only with the source corresponding thereto, for conducting from each secondary element to the corresponding source as an injection locking signal such portion of such energy free space coupled to the secondary element, so that said corresponding source generates microwave energy at such a higher level and at said frequency, and for conducting to each secondary element from such corresponding source such higher level energy generated thereby so that the secondary elements coherently radiate into free space microwave energy generated by said set of sources corresponding to the secondary elements.

4. The system of claim 3 wherein each transmission line of said set of secondary transmission lines includes controllable phase shifter means for changing, at said frequency, the phase relation between microwave energy coupled to the corresponding secondary element from the primary element and microwave energy conducted to said corresponding secondary element so as to steer a beam of coherent radiation at said frequency.

5. The system of claim 4 wherein each of said elements is a patch element of a microstrip array, each of said microwave sources is an IMPATT diode, and each of said phase shifter means is a varactor diode.

* * * * *